US010113848B2

(12) United States Patent
Germani et al.

(10) Patent No.: US 10,113,848 B2
(45) Date of Patent: Oct. 30, 2018

(54) BLAST MITIGATION DEVICE AND METHOD

(71) Applicant: D'APPOLONIA S.P.A., Genoa (IT)

(72) Inventors: Gianfranco Germani, Genoa (IT); Donato Zangani, Genoa (IT); Alessandro Bozzolo, Genoa (IT); Samuele Ambrosetti, Genoa (IT); Daniele Pozzo, Genoa (IT)

(73) Assignee: D'APPOLONIA S.P.A., Genoa (IT)

( * ) Notice: Subject to any disclaimer, the term of this patent is extended or adjusted under 35 U.S.C. 154(b) by 0 days.

(21) Appl. No.: 15/515,001

(22) PCT Filed: Sep. 28, 2015

(86) PCT No.: PCT/EP2015/001914
§ 371 (c)(1),
(2) Date: Mar. 28, 2017

(87) PCT Pub. No.: WO2016/050346
PCT Pub. Date: Apr. 7, 2016

(65) Prior Publication Data

US 2017/0299363 A1 Oct. 19, 2017

(30) Foreign Application Priority Data

Sep. 29, 2015 (IT) ..... MI2014A1695

(51) Int. Cl.
*F42B 33/00* (2006.01)
*F42D 5/045* (2006.01)

(52) U.S. Cl.
CPC ..... *F42D 5/045* (2013.01)

(58) Field of Classification Search
CPC ..... F41H 5/06
(Continued)

(56) References Cited

U.S. PATENT DOCUMENTS 6,865,977 B1 * 3/2005 Kim ..... F42L 339/14 109/49.5
8,186,505 B1 5/2012 Saucedo
(Continued)

FOREIGN PATENT DOCUMENTS

EP 2492217 A1 8/2012
GB 2242619 A 10/1991
WO 03067178 A1 8/2003

OTHER PUBLICATIONS

International Search Report dated Dec. 3, 2015 re: Application No. PCT/EP2015/001914; pp. 1-3; citing: GB 2 242 619 A, WO 03/067178 A1 and U.S. Pat. No. 8,186,505 B1.
(Continued)

*Primary Examiner* — J. Woodrow Eldred
(74) *Attorney, Agent, or Firm* — Cantor Colburn LLP

(57) ABSTRACT

A blast mitigation device having a first inner bag intended to house an explosive and further including a second outer bag to freely contain the first bag. Structural connections between the first and second bag are absent. The first and second bags each include a flexible tubular body made of textile material, provided with at least one openable mouth at one end of the flexible tubular body. The mouth is closable by a zip fastener or zipper and wherein at least the second bag includes a closure belt or strap arranged astride the openable mouth, such that in the assembled and use condition the zip fastener or zipper is wound inside a roll of an end portion of the body of the corresponding bag. The roll is kept in position by the at least one strap.

11 Claims, 10 Drawing Sheets

(58) Field of Classification Search
USPC ..... 86/50
See application file for complete search history.

(56) References Cited

U.S. PATENT DOCUMENTS

2008/0257137 A1* 10/2008 James ..... F42D 5/045
86/50
2011/0023693 A1* 2/2011 Warren ..... F41H 5/0414
86/50

OTHER PUBLICATIONS

Written Opinion dated Dec. 3, 2015 re: Application No. PCT/EP2015/001914; pp. 1-5; citing: GB 2 242 619 A and WO 03/067178 A1.

* cited by examiner

BLAST MITIGATION DEVICE AND METHOD

TECHNICAL FIELD

The present invention relates to the field of blast mitigation devices and methods.

The invention has a preferred and advantageous, but not limitative, application to the aeronautical field, where the problem of finding measures of protection against explosion devices on board an aircraft is clearly more important than situations where escape routes are present.

Installations in public places can be further fields of interest, such as libraries, shopping centers, airports, stations, ships or more in general anywhere there are closed spaces where many people are contemporaneously present and where, therefore, the results of an explosion can be particularly harmful, both for people and structures.

PRIOR ART

With reference first to the aeronautical field, remind that in the last years the increase in terrorism all over the world has required defining a series of measures to be taken in order to try to make passenger aircrafts more safe.

Particularly a research has been carried out for finding solutions for mitigating the effects of a possible explosion of explosive devices concealed on board aircrafts, an event that most of the times has caused catastrophic results.

In order to do this, the object has been to protect civil aviation from the threat of explosives by a series of measures such as:

- preventing explosives from reaching the aircraft;
- mitigating the effects of an explosive placed therein;
- making the aircraft more resilient as regards dynamic loads as those generated by explosions.

One has to consider the possibility and the consequent risk that a small amount of explosive, not detected since below the threshold of the detection instruments used by security bodies and authorities, can pass unnoticed to the inspections.

If this occurs useful countermeasures have to be taken and provided to reduce the effects of possible explosions on board the aircraft.

The same thing, in short, can be valid when the explosion to be confined is not the one coming from an explosive device, but the one of a device harmless in itself: for example think of lithium batteries of electronic apparatuses present on board or owned by the passengers of the aircrafts. In the past air disasters have occurred, particularly in cargo aircrafts, just for the explosion of lithium batteries transported in the cargo compartment, that have generated on-board fire.

Still, a similar problem occurs any time there are areas, typically closed ones, where many people are present (cinemas, libraries, shopping centers, concert rooms or the like) and therefore where the results of an explosion may involve people and/or damage structures (till even causing the collapse thereof).

With reference again to the case of greater interest, that of aircrafts, solutions have been studied in the past based on hardening the containers usually used for transporting baggage on board twin-aisle aircrafts (called in English as "wide-body aircraft"). Such containers, called as ULD "Unit Load Device" have standard dimensions fitting the inner spaces of the different aircraft types. The ULD is loaded with baggage and placed, once loaded, under the aircraft where it is loaded in the cargo compartment. The ULD therefore is transported full of baggage in the cargo compartment, on the same aircraft as the passengers owning the baggage, where it is fastened in the cargo compartment by means of suitable standard hooks.

ULD generally is made of riveted aluminium, with a weight of few dozens of kilograms, with a front opening closed by a flexible element.

ULDs generally are used in wide-body aircrafts for long-range flights, for example transcontinental flights. Single-aisle aircrafts (called in English as "narrow body aircraft") usually do not use ULDs for loading baggage in the cargo compartment, due to the small dimensions of the cargo compartment of such aircrafts, where the cargo compartment is loaded with loose baggage. As mentioned above, the possibility of hardening ULDs has been studied in the past for mitigating the effects of an explosion of an explosive device concealed in baggage transported therein.

The research, mainly carried out in the United States in consequence of the Lockerbie bombing, has caused some hardened ULD models to be developed (called as Hardened ULD, HULD), however characterized by a high cost (in the order of dozens of thousands of dollars) and also by a high weight (in the order of hundreds of kilograms), not compatible with the requirements of the aeronautical field, resulting in HULDs not having a commercial application.

Moreover they can be applied only for wide-body aircrafts, while the protection of the other aircrafts cannot be guaranteed.

A further case is the one of explosive devices or anyway devices having a suspicious nature found during the flight in the passenger compartment of the aircraft.

In this case it is not possible to move the suspicious device into a HULD, if any, in the cargo compartment, since generally the cargo compartment of the aircraft is physically separated from the passenger compartment and it cannot be reached directly therefrom.

The procedures in use on normal aircrafts specify that, should a possible explosive device be found, it has to be placed in an area of the passenger compartment called as "Least Risk Bomb Location", LRBL, in practice an area of the passenger compartment where in case of a possible explosion this latter would have an effect the least dangerous as possible with respect to other areas in the aircraft. Often the LBRL is located at the door in the rear part of the passenger compartment.

It is obvious that such solution, even if the only one applicable in the passenger compartment for now, is not at all optimal as regards prevention of air disasters caused by possible explosive devices.

It is also known that it is preferable to have available a wide containment volume for completely contain the overpressure generated by the explosion since the maximum value of the pressure quickly decreases as the distance from the explosion site increases.

It is also known that it is not easy and inexpensive to have available wide empty spaces in aircrafts where each space is tried to be filled with devices useful for the flight as well as objects and things to be transported, thus minimizing the empty spaces.

Such important limits therefore have led to define new solutions to the problem of mitigating explosions on board aircrafts, above all narrow-body aircrafts where spaces are limited.

A solution to such main drawbacks is suggested in the patent EP 2492217 providing a suitable blast-resistant container system that is very light and entirely textile-based.

Such system is arranged in suitable spaces provided inside the cargo compartment of the aircraft, employing the same hooking points for the ULDs.

As said above, however it is still impossible to access the container of EP 2492217 when the explosive device is found during the flight in the area of the passenger compartment, since there is not a direct access between the cabin (passenger compartment) and the cargo compartment.

OBJECTS AND SUMMARY OF THE INVENTION

It is the object of the present invention to overcome the drawbacks of the prior art.

The general object of the present invention therefore is to solve the prior art drawbacks mentioned above in a very easy, cheap and particularly functional manner. Another object of the present invention is to provide a blast mitigation device, lightweight and relatively simple to be manufactured and used.

Still another object of the present invention is to provide a blast mitigation device that does not need any particular arrangement for being placed inside the aircraft.

Still another object is to provide a mitigation device that is easy to be transported, foldable and quickly usable as soon as a possible explosive device is found. These and other objects of the present invention are achieved by a device embodying the characteristics of the annexed claims, which are an integral part of the present description.

In view of the above objects, according to the present invention, we have thought of providing a blast mitigation device having the characteristics set forth in the annexed claims.

Particularly, a first object of the invention is a blast mitigation device, comprising a first bag intended to house an explosive and a second bag,

- the first bag, the inner one, being housed freely in the second bag, the outer one,
- structural connections between the first and the second bag being absent,
- the first bag and the second bag comprising each a flexible tubular body made of textile material, provided with at least one openable mouth at one end of said flexible tubular body, said mouth being closable by a zip fastener or zipper and wherein
- at least the second bag comprises a closure belt or strap arranged astride said openable mouth, such that in the assembled and use condition said zip fastener or zipper is wound inside a roll of an end portion of the body of the corresponding bag, said roll being kept in position by said at least one strap.

According to one feature, taken alone or in combination with the above features, the textile material of said first and second bag is synthetic textile material, preferably a para-aramid multi-layer material.

According to one feature, taken alone or in combination with the above features, the textile material of said first and second bag is a synthetic textile material, preferably para-aramid multi-layer material.

According to another feature, taken alone or in combination with the above features, the textile material of said first and second bag is made at least of a single piece of textile material wound on itself for a number of times equal to a number of layers of the multi-layer material, seams being provided between the individual layers, preferably lockstitch seams.

According to another feature, taken alone or in combination with the above features, the first bag comprises at least one layer of foamed material interposed between two layers, preferably a plurality of layers of foamed material alternating with layers of textile material.

According to another feature, taken alone or in combination with the above features, at least one bag, preferably both, comprise only one openable mouth and a blind bottom on the side of the body opposite to said openable mouth, said blind bottom being formed by flattening an end portion of the body of the bag adjacent to the blind bottom, said flattened end portion being folded and firmly and extensively kept fastened by a series of seams which are transversal to the body and parallel with each other, with a zig-zag and crossed pattern.

According to another feature, taken alone or in combination with the above features, the device comprises a third bag or reinforcement shield, interposed between the first bag and the second bag, said third bag being made preferably of the same material as said first and/or said second bag.

According to another feature, taken alone or in combination with the above features, the textile material is permeable to gases, particularly permeable to air.

According to another feature, taken alone or in combination with the above features, the devices comprises one or more reinforcement belt or straps on said first inner bag.

According to another feature, taken alone or in combination with the above features, at least one of the inner bag or outer bag has two openable mouths at the end sides of said body.

According to another feature, taken alone or in combination with the above features, at least one of the inner bag or outer bag or the shield is provided by reinforcing strips extending substantially perpendicularly with respect to said zip fastener or zipper.

Another object of the invention is a method for containing or mitigating an explosion providing at least the step of using a blast mitigation device of the invention.

Further advantageous characteristics are the subject matter of the annexed claims, which are an integral part of the present invention.

BRIEF DESCRIPTION OF THE DRAWINGS

The invention will be described below with reference to non-limiting examples, provided by way of example and not as a limitation in the annexed drawings. These drawings show different aspects and embodiments of the invention and, where appropriate, reference numerals showing like structures, components, materials and/or elements in different figures are denoted by like reference numerals.

In the annexed figures.

DETAILED DESCRIPTION OF THE INVENTION

Figure 1:
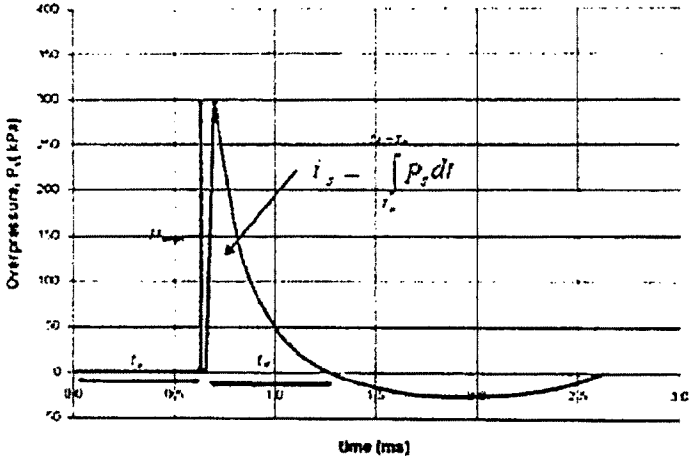
FIG. 1 is a plot of the trend of overpressure over time generated by a single explosion in open air.

While the invention is susceptible of various modifications and alternative forms, some preferred embodiments are shown in the drawings and will be described below in detail.

It should be understood, however, that there is no intention to limit the invention to the specific embodiment disclosed, but, on the contrary, the intention of the invention is to cover all modifications, alternative constructions and equivalents falling within the scope of the invention as defined in the claims.

The use of "for example", "etc", "or" indicates non-exclusive alternatives without limitation unless otherwise defined.

The use of "including" means "including, but not limited to," unless otherwise defined.

Terms as "vertical" and "horizontal", "upper" and "lower" (with no other indications) have to be read with reference to the assembling (or operating) conditions and with reference to the standard terminology in use in common speech, where "vertical" means a direction substantially parallel to that of the vector of the force of gravity "g" and horizontal means a direction perpendicular thereto.

Before going into the detailed description of the invention, we had better to explain some aspects of the phenomena related to the explosion of an explosive device, particularly those related to the trend of the pressure at a point near the blast site.

In the milliseconds immediately following the explosion a heavy impulsive load (called as "shock holing") with a high intensity, very localized and with a short duration is generated which is transmitted to the structures in contact with the charge. In the milliseconds following the explosion the produced gases expand generating a uniformly distributed pressure wave substantially expanding like a sphere.

The passage of the pressure wave through air, initially in an undisturbed condition, causes it to be compressed and exerts an acceleration to air particles in a radial direction with respect to the blast site.

A pressure sensor localized along the path of the pressure wave would register a pressure wave as the one shown in FIG. 1.

The arrival of the shock wave corresponds to the time to at a peak of the pressure value (overpressure) that exponentially decreases till reaching again the ambient value.

FIG. 1 shows the trend of overpressure over time generated by a single explosion in open air (in the abscissa the unit of measurement is millisecond, in ordinate KiloPascal, KPa).

If the explosion takes place inside a closed volume, as the container, a second effect is added to the above effect which is due to multiple reflections of the pressure wave on the walls of the container: the tails of each peak are summed together, resulting in an effect of overall pressure build-up higher than the ambient one and known as quasi-static pressure (QSP), that can last several seconds. The maximum pressure associated to this second phase usually is very lower than the one associated to the pulse, but due to its long duration it can cause serious damages too.

Figure 2:
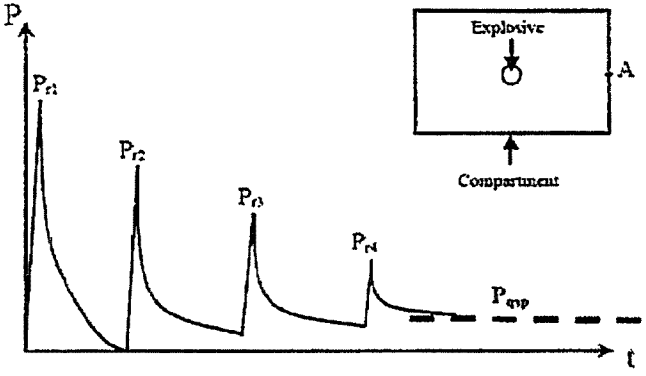
FIG. 2 is a plot of the trend of overpressure over time generated by a single explosion in a closed volume.

FIG. 2 shows the trend of overpressure over time after an explosion with multiple reflections (in the abscissa the unit of measurement is millisecond, in ordinate KiloPascal, KPa).

For a more accurate treatment see the document "*Pulse pressure loading of aircraft structural panels*", Thin-Walled Structures 44 (2006) by Simmons, M C & Schleyer, G K.

Figure 3:
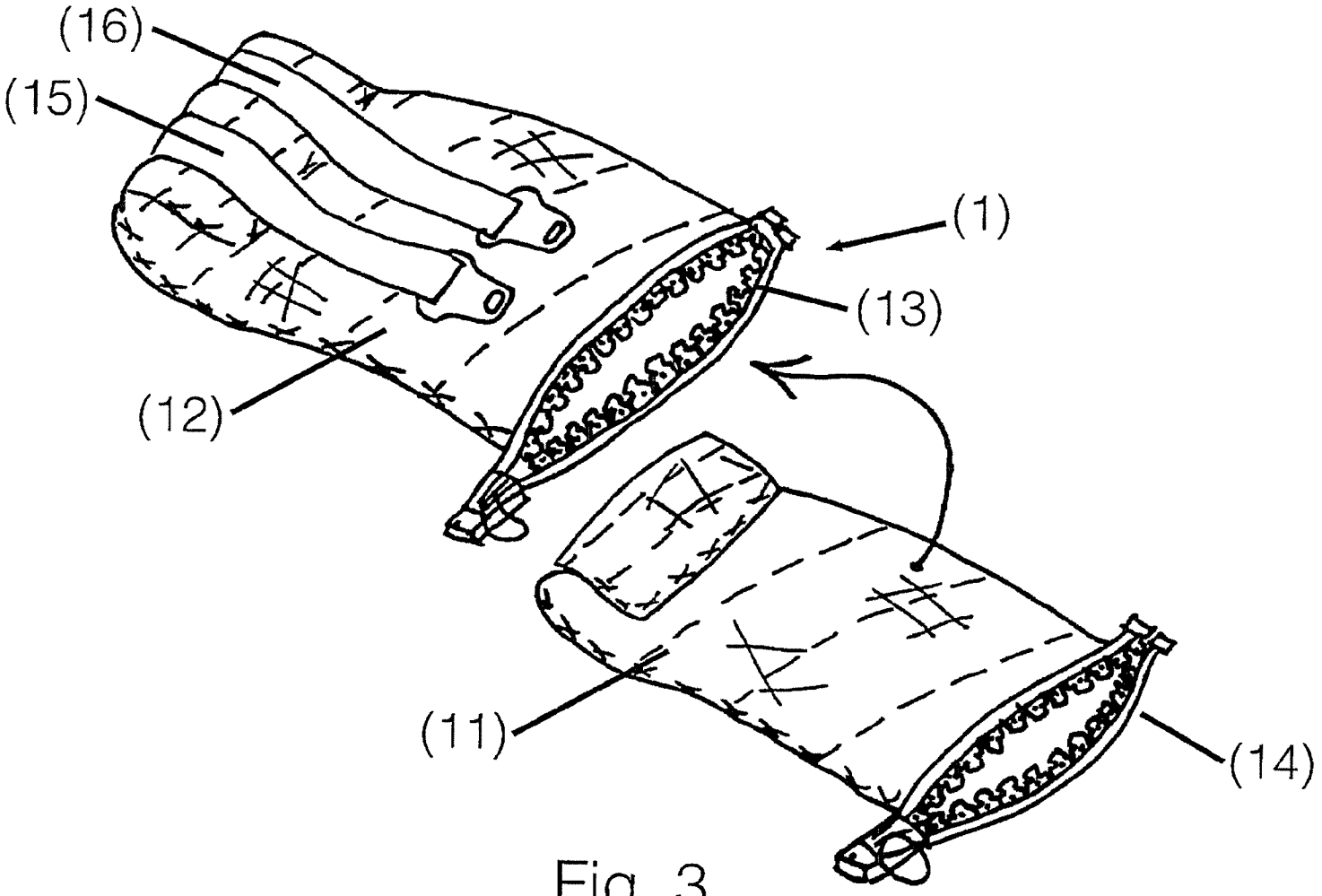
FIG. 3 is a perspective schematic view of an embodiment of a blast mitigation device according to the present invention in the disassembled condition.
Figure 4:
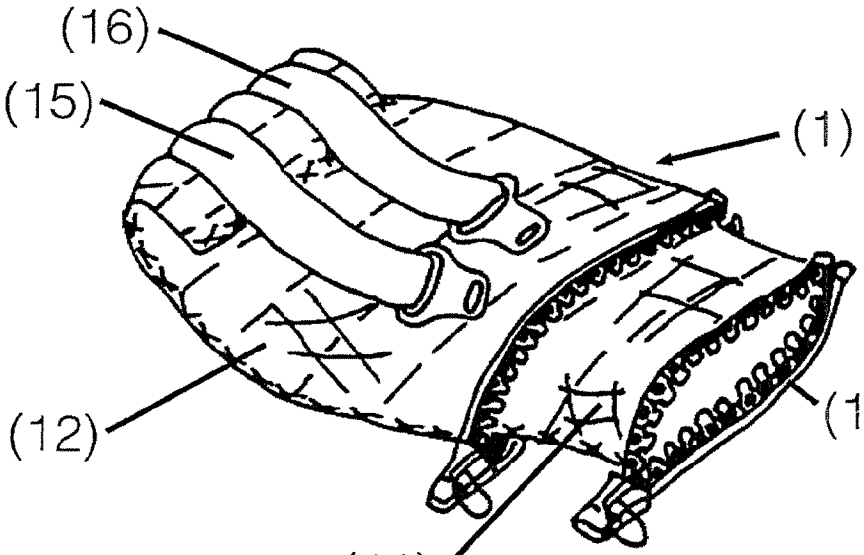
FIG. 4 is a perspective schematic view of a the embodiment of a blast mitigation device according FIG. 3 open and ready to receive the explosive.
Figure 5:
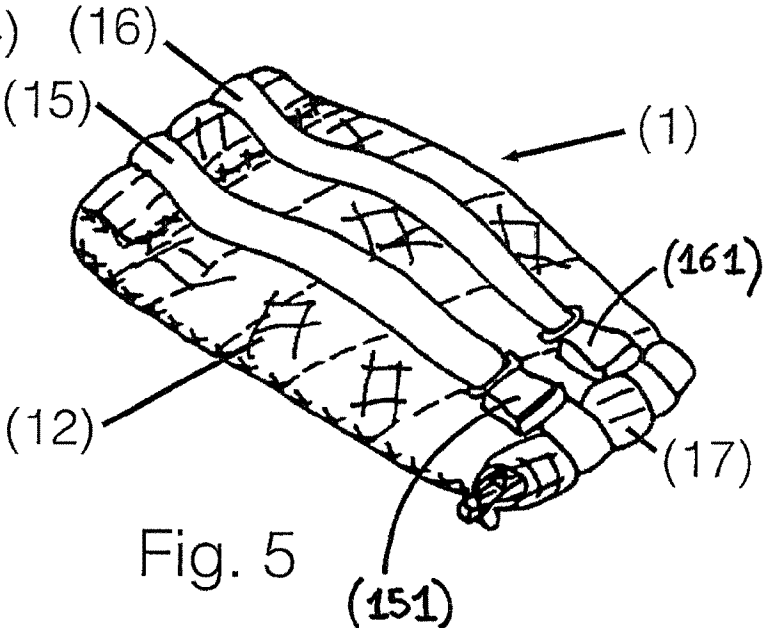
FIG. 5 is a perspective schematic view of the blast mitigation device according to FIG. 3 or 4 in the closed condition.

Now with general reference to FIGS. 3, 4 and 5 they show a first, preferred but not limitative, first embodiment of a blast mitigation device, carried out according to the invention.

It is generally denoted by the reference numeral 1. FIG. 3 shows the device in the disassembled condition; FIG. 4 shows the device deployed and ready to receive the explosive, while FIG. 5 shows the closed device after the explosive device has been inserted therein. This device 1 is intended to be used, as said above, in a situation when an explosive object or device, for example found on board an aircraft, during the flight, has to be isolated as soon as possible.

The device is designed and manufactured such to be placed at an area called as "Least Risk Bomb Location" (LRBL) such to limit the effects generated by the explosion (if any) and such to contain the fragments of the device projected by the explosion, in the best possible manner. Substantially the blast mitigation device 1 made according to the invention comprises an inner container or bag (11), an outer container or bag (12) intended to contain the blast chamber, called also as inner bag (11). Then zippers or zip fastener (13), (14) are provided for closing the open ends of both the containers or bags, (11), (12) respectively; each bag comprises its flexible tubular body as described more in detail in the following: said tubular bodies, being in at least one configuration cylindrical (for example when an internal pressure is applied on the body, the latter deformate in a substantially cylindrical shape, just like a flexible, soft sleeve).

In addition, optionally, it is possible to provide at least one longitudinal outer strap or belt (in the example they are shown in the number of two and are denoted by (15) (16), but they can be provided also in a different number) and, optionally, transverse bands or ribs (not shown in the drawing in FIGS. 3, 4 and 5), the longitudinal belts running therein.

Each one of such straps (15), (16) that surrounds the outer bag (12), is firmly engaged with the outer surface of the outer container or bag (12): the free ends of the straps (15), (16) are firmly connectable with each other once the explosive object (not shown) has been placed inside the device and the device has been closed.

Such straps (15), (16) can advantageously be of the same type as safety belts currently used in the aeronautical field; this leads to the advantage of having already available straps that have been approved and certified for the use in the aeronautical field and whose strength has been verified to be enough for the objects of the invention.

Each strap (15), (16) can be provided by closing devices 151, 161 for a fast closure of the same, for example buckle or similar.

As an alternative, the belts (15), (16) can be made of two parts, each one firmly engaged with the opposite outer surfaces of the outer bag (12).

Even if in FIGS. 3, 4 and 5 a simplified solution is shown, where the straps (15), (16) are placed only on the outer bag, astride of the openable mouth thereof, in more evolved solutions it is provided that such straps can be in the number of three or more.

In other embodiments, in combination with the outer straps at least one, preferably two, three or more closing straps are provided fastened on the inner bag (11) and placed astride of its open mouth, similar to what described for the straps placed on the outer bag. The functionality of such straps (15), (16) and of those possibly present on the inner bag (11) will be more clear from the following description.

Both the inner container or bag (11) and the outer container or bag (12) composing the blast mitigation device made according to the invention are made completely of textile materials.

Further reference to the particular type of textile material will be made below, now suffice it to note that they are flexible and foldable.

The two bags (11) and (12) comprises two textile cylindrical bodies (with reference to an expanded condition, like a sleeve) that in the assembled condition are placed concentrically, one inside the other one, with the open mouths facing the same side, such as shown in FIG. 4.

The two bags (11) and (12) advantageously have the smallest possible number of structural seams or any. Thus the points of a possible breaking are reduced and at the same time keeping the largest possible surface of the material (composing the bags) as intact, not subjected to perforations of seams that could result in weak points in the device structure.

In the preferred shown solution the inner bag (11) and the outer bag (12) have different dimensions, such that the first one (11) can be housed into the second one (12) in the assembled condition.

The inner bag (11) and the outer one (12) can be made in a similar manner, only having different dimensions or, preferably, the inner bag can have a different textile structure than the outer one.

Figures 6, 6A, 6B:
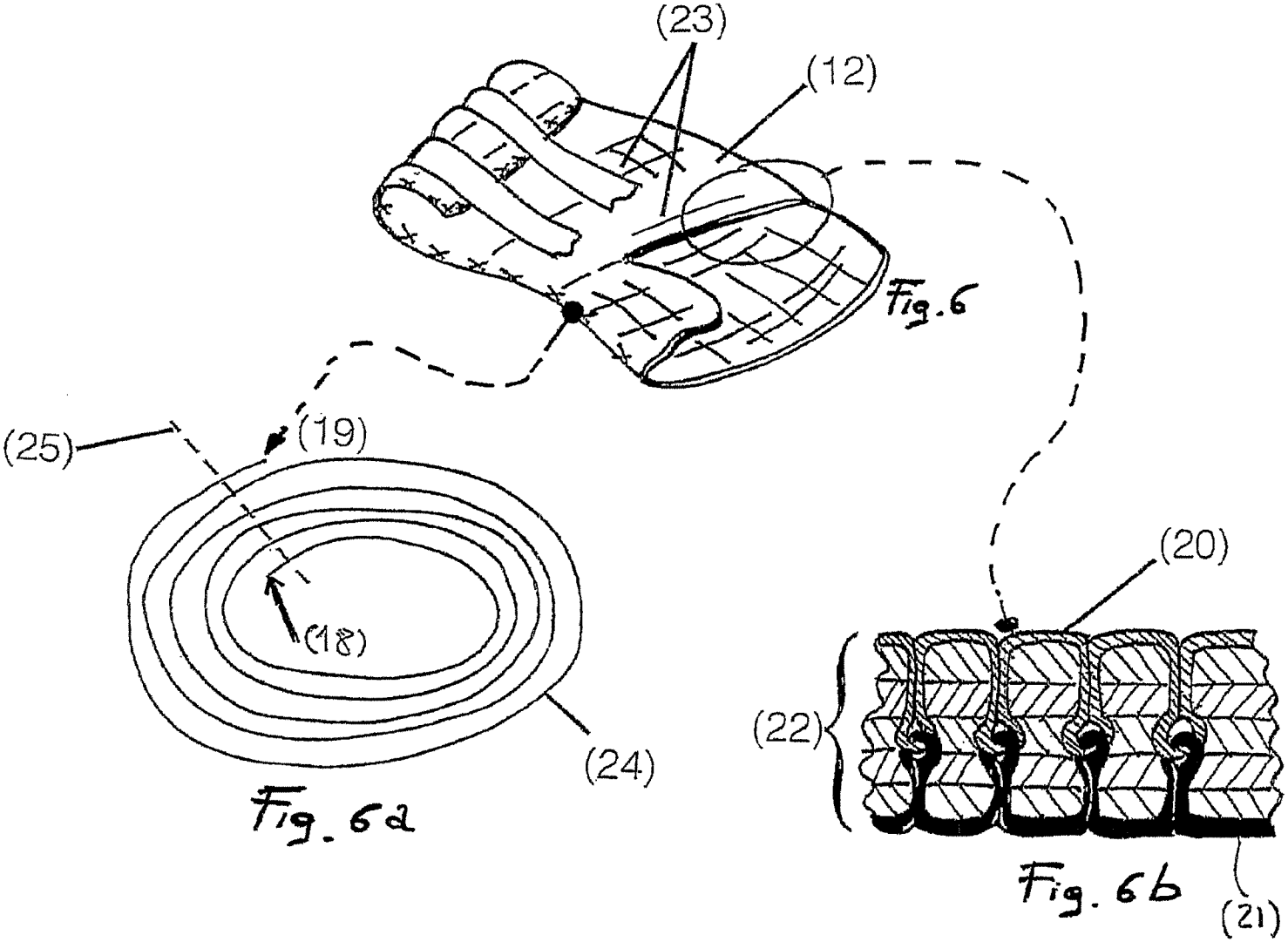
FIGS. 6, 6*a* and 6*b* are a schematic view of the outer bag of the device of the invention and its details of the number of layers of the textile material and of the type of seams provided thereon.

With reference to FIG. 6, 6*a*, 6*b* it is shown a particularly advantageous embodiment of the outer bag (12) with details about the number of layers of the textile material and the type of seams present therein. The outer bag (12) is composed of a single piece of fabric (24) made of a para-aramid fiber or other high mechanical resistance technical fiber which is wound starting from a free edge (18) that during the manufacturing is kept fixed, while the remaining portion is wound on itself (or better around a rectangular core, for example a board made of plywood or cardboard, that later is removed) for a given number of times till obtaining the desired number of layers (five in this case).

The two free edges (18) and (19) of the piece of fabric, shown in FIG. 6, are connected by means of a series of seams (25), having zig-zag and crossed pattern, such as shown in the detail of FIG. 6*a*, 6*b*.

The layers of the outer bag (12) are fastened by means of circular and spiral-like seams (23), that is starting from one edge of the container and arriving to the other edge after a number of spiral-like turns on the container wall, such as shown in FIG. 6,6*a*,6*b*.

FIG. 6,6*a*,6*b* also shows the overlapping of the several layers of textile material composing the outer bag (12) (in this case in a number of five) and it shows the manner by means of which they are connected, that is by a lockstitch seam.

More precisely, in the detail of FIG. 6*b*, a section in the thickness of the multi-layer is shown, at a spiral-like seam (23).

Seams are preferably made with yarns of para-aramid or other high-resistance technical fiber (21) faced on the inner side of the bag (fed by the shuttle of the sewing machine) and yarns of polyester or other high tenacity technical fiber (20) faced on the opposite side (carried by the needle) that is the outer side of the bag.

It has to be noted that seams made in this manner do not have a real structural function; such function on the contrary is performed by the fabric in its continuity. In substance and in other words it is possible to say that the tearing strength provided by the seams is considerably lower than that of the material of the several layers.

The main function of seams is to keep the several layers in place, making all of them working together, thus maximizing the performances and avoiding creating folds or flaps that can be an obstacle during the operation using the device or that can limit its efficacy.

On the side opposite to the openable mouth, the bag (12) has a blind bottom.

Figures 7, 7A:
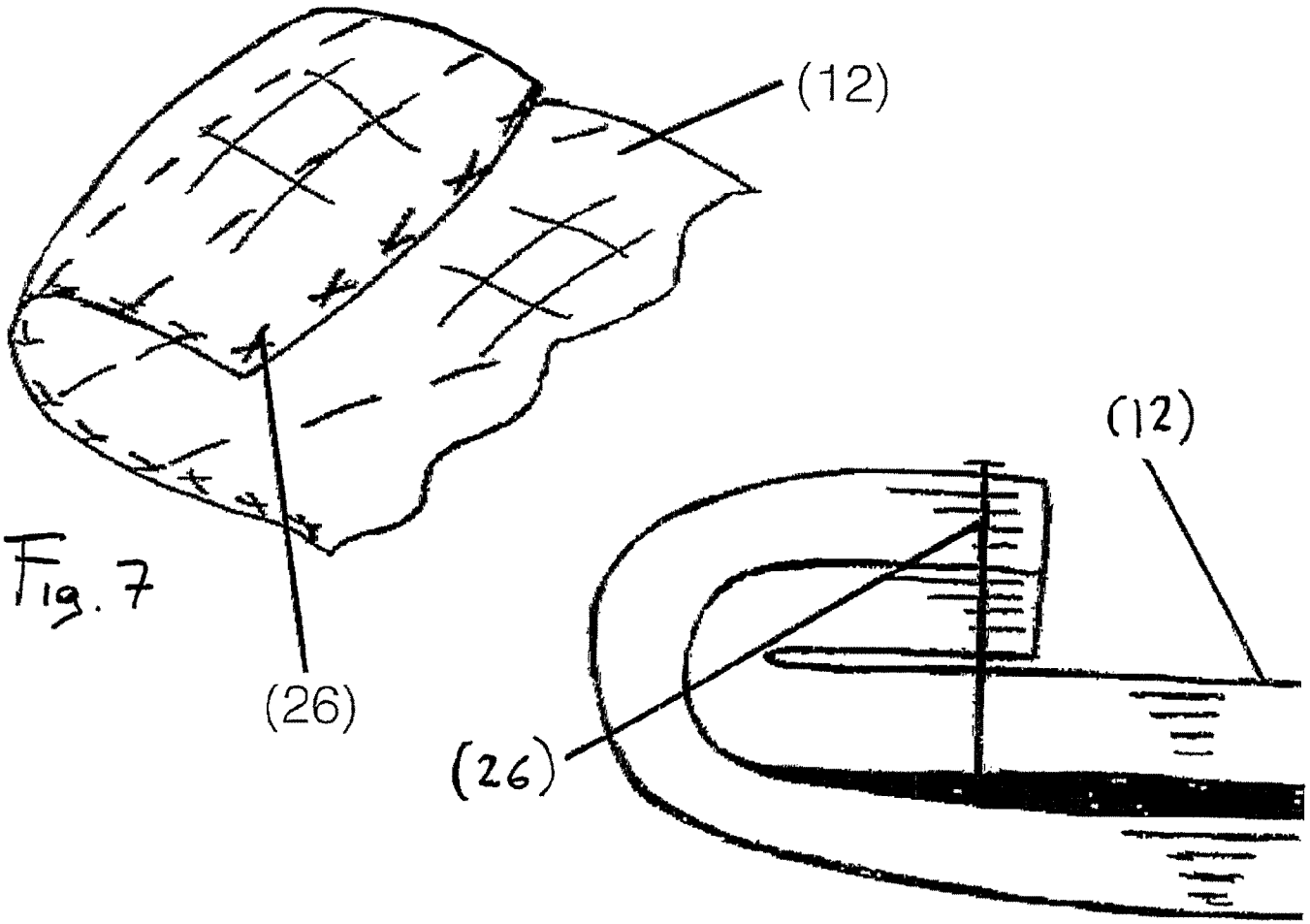
FIGS. 7 and 7*a* are a schematic views of the closure of the bottom of the outer bag (12)

With reference to FIG. 7, such blind bottom (26) (opposite to the openable mouth) is closed by flattening an end portion of the bag (12) (preferably of the flexible tubular body), adjacent to the bottom which is then kept integrally and extensively fastened by a series of seams transverse to the cylindrical bag and parallel with each other with a zig-zag and crossed pattern. Therefore the blind bottom is made by folding (at least one fold) the fabric of the bag body, which is closed on the bag body by means of seams (26).

Such seams (26), in the exemplary case of the five windings, are made preferably by perforating fifteen layers of fabric (three multilayer, each comprising five layers, from the inside of the bag to the outside), such as in the detail of FIG. 7*a*.

Thus due to the inner overpressure in case of an explosion said seams are not transversally stressed, which may promote a progressive breaking mechanism, but they are stressed in their plane with higher resistance resources.

In an alternative embodiment, the bottom side is closed as described above but with the addition of some windings of the fabric folded and sewn in this manner.

The windings of the fabric are locked by the longitudinal belts, which are joined at the loading mouth by means of quick fasteners (151), (161).

In another (not shown) embodiment on the contrary both the ends of the flexible tubular body are provided with open mouths closable by means of zippers.

Figures 8, 8A:
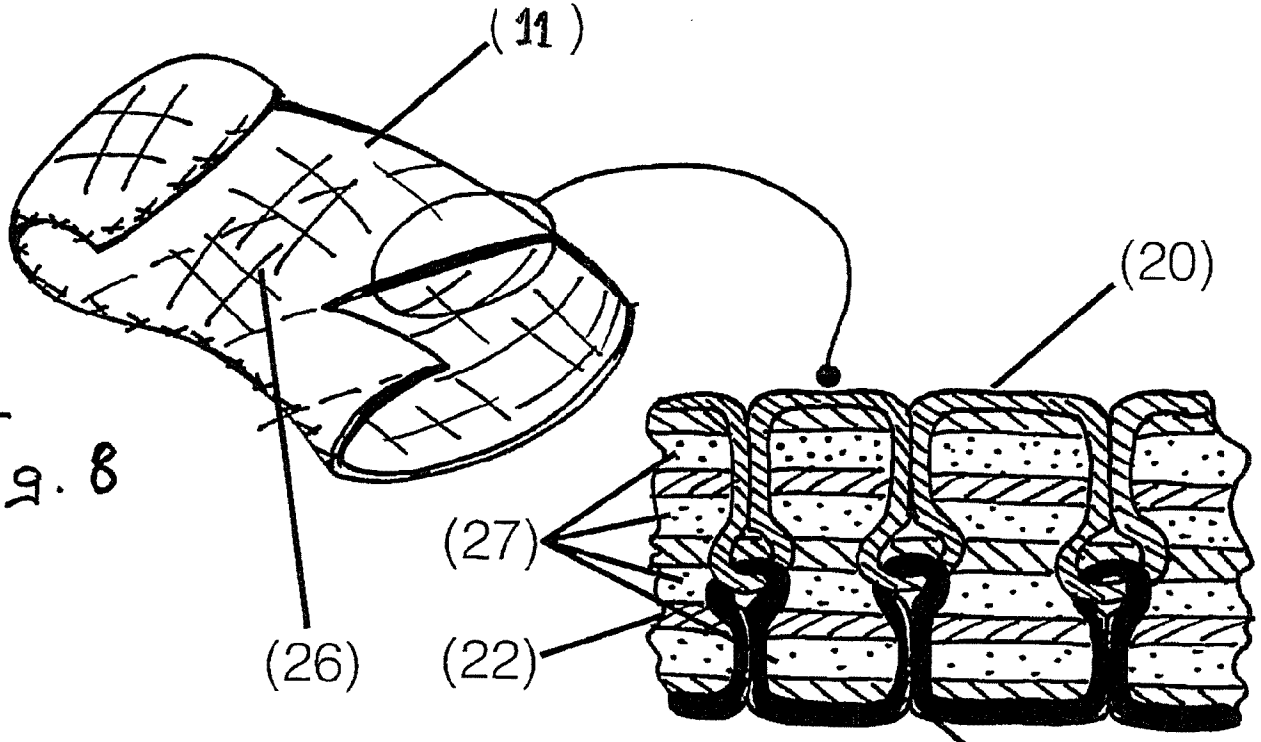
FIGS. 8 and 8*a* are a schematic view of the inner bag of the device of the invention, of the preferred number of layers of the textile material and of the types of seams provided thereon.

In another embodiment the inner bag (11) is identical to the outer bag (except for the dimensions), that is it is composed of a single piece of fabric made of para-aramid fiber or other high mechanical resistance technical fiber, wound in a manner similar to what described above. In a further embodiment of the inner bag (11), shown in FIGS. 8 and 8*a*, the layers of para-aramid material are alternated with further layers made of foamed material (27), such as for example a membrane of foamed polyethylene, having a thickness of some millimeters, preferably 3 mm, acting for spacing the fabric layers (22) of para-aramid fiber or of other high mechanical resistance technical fiber.

The seams of the inner bag (11), both those of the bottom and the longitudinal ones, are made like those of the outer bag (12) as described up to now and no further reference is made thereto for brevity reasons.

At the openable mouth of the inner bag (11) and/or outer bag (12) a special zipper or zip fastener (14) and (13) respectively (FIG. 3) is fastened by means of multiple seams.

More in general, such zippers comprise two basic tapes each one carrying mutual engaging teeth and at least one slider the moves the teeth of the first and second zipper in a mutual engagement or disengagement condition; zippers then comprise also stops that join the zippers at their end portions and prevent the slider from coming off the zipper.

Preferably the teeth of the zipper are produced by pressure die casting of high-modulus thermoplastic resin.

An example of a particularly useful thermoplastic resin is POM (Polyoxymethylene); POM is a plastic material high a high stability, stiffness and temperature resistant.

The tensile strength of each individual tooth of the zipper or zip fastener is further optimized by a self-tapping screw that passes through it at the center engaging also, contemporaneously, the tape.

Such screw clamps the tooth body around the tape such to avoid breaking it when a strong tensile force is applied. Preferably glass fiber reinforced nylon is used for the sliders.

Preferably for the tape a fabric made of aramid for the weft and polyester for the warp is used.

Preferably for the stops at both the ends aluminium alloys are used.

With the device (1) in the closed condition (such as shown in FIG. 5) it has at least one and preferably more than one textile winding both of the outer bag (12) and of the inner bag (11) around at least one, preferably both, the zip fasteners (13), (14) (see FIG. 5), such to avoid the whole explosion force to accidentally open or break them. FIG. 5 shows, by way of example, the winding (17) that is made on the outer bag (12).

A similar winding will be present also on the inner bag (11) and contained within the outer bag (12).

The textile windings of the inner and outer bags are made of the same bags (11), (12), that are separately wound around the respective zip fasteners (14), (13) and firmly kept therein in the wound condition by the belts that are tightened avoiding them to be unwound.

In order to do this it has to be noted (FIG. 5) how the belts or straps extend substantially perpendicular to the zip fasteners (13), (14) which in addition are a real guide to quickly wind the bag (11) and the bag (12) on itself.

Thus also in case of situations of particular agitation and confusion it is possible to properly close the device (1).

The zip fasteners at the mouth of both the bags (11), (12) therefore are protected by winding a part of the empty portion of the body of the bag (11), (12) adjacent thereto, thus resulting in being arranged just in the innermost part of such winding or roll.

Preferably the inner depth of the textile bags (11), (12) is equal to the width of the fabric (e.g. 2.50 m) minus the band folded for closing the bottom.

Thus it is possible to contain within the device (1) an entire object having maximum dimensions allowed for hand-luggage of a civil flight, with wide additional inner space free (for the length).

From the studies and experiments made by the inventors it has been found that the use (for the bags (11), (12)) of a gas permeable material is optimal.

The gas permeability of the chamber inside the bag (11) (when the device 1 is assembled) is able to discharge a part of the power and amplitude of the shock wave (initial pressure peak) before reaching the first breaking of the bag (11).

The outer bag (12), greater has regards diameter and volume capacity, therefore is stressed (in case of an explosion) with such a time delay to follow the peak moment of the explosive energy.

It results that (reminding what said for FIG. 1) the outer bag (12) is stressed only by the residual energy following the first breaking of the inner bag (11). Such residual energy moreover meets a greater volume space where it can get distributed, the bag (12) being the outer one and therefore more capacious.

In an evolved configuration of the device 2 (shown in FIG. 9 and FIG. 10) in order to mitigate said "shock-holing" phenomenon (that can cause the device to be perforated in the point where the explosive is placed) a third component can be added, in addition to the two inner bag (11) and outer bag (12).

The material used for such element, is called as intermediate 'shield' (28).

Such shield (28), as the bags (11), (12), has a flexible tubular shape and it is made of the same material used for the other components.

The 'shield' is made in a manner similar to what described above, with the difference that it has no zipper or zip fastener.

An alternative configuration provides the tubular element to be opened at the two ends.

However the 'shield' can be also composed of INNEGRA/DYNEEMA fabric, if the overall weight is desired to be reduced.

Figure 9:
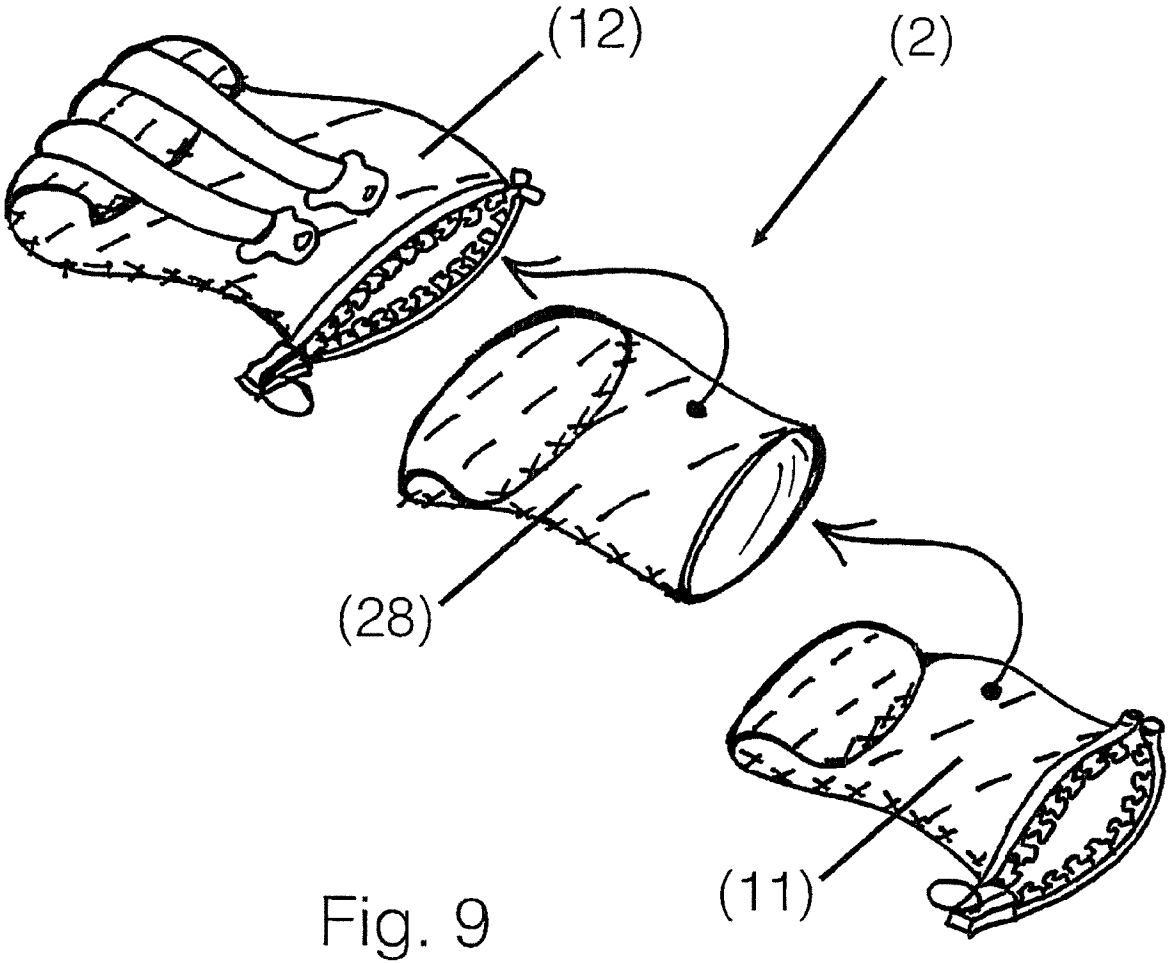
FIG. 9 is a schematic view of a blast mitigation device according to another embodiment of the invention in a disassembled condition, including a reinforcement 'shield'.
Figure 10:
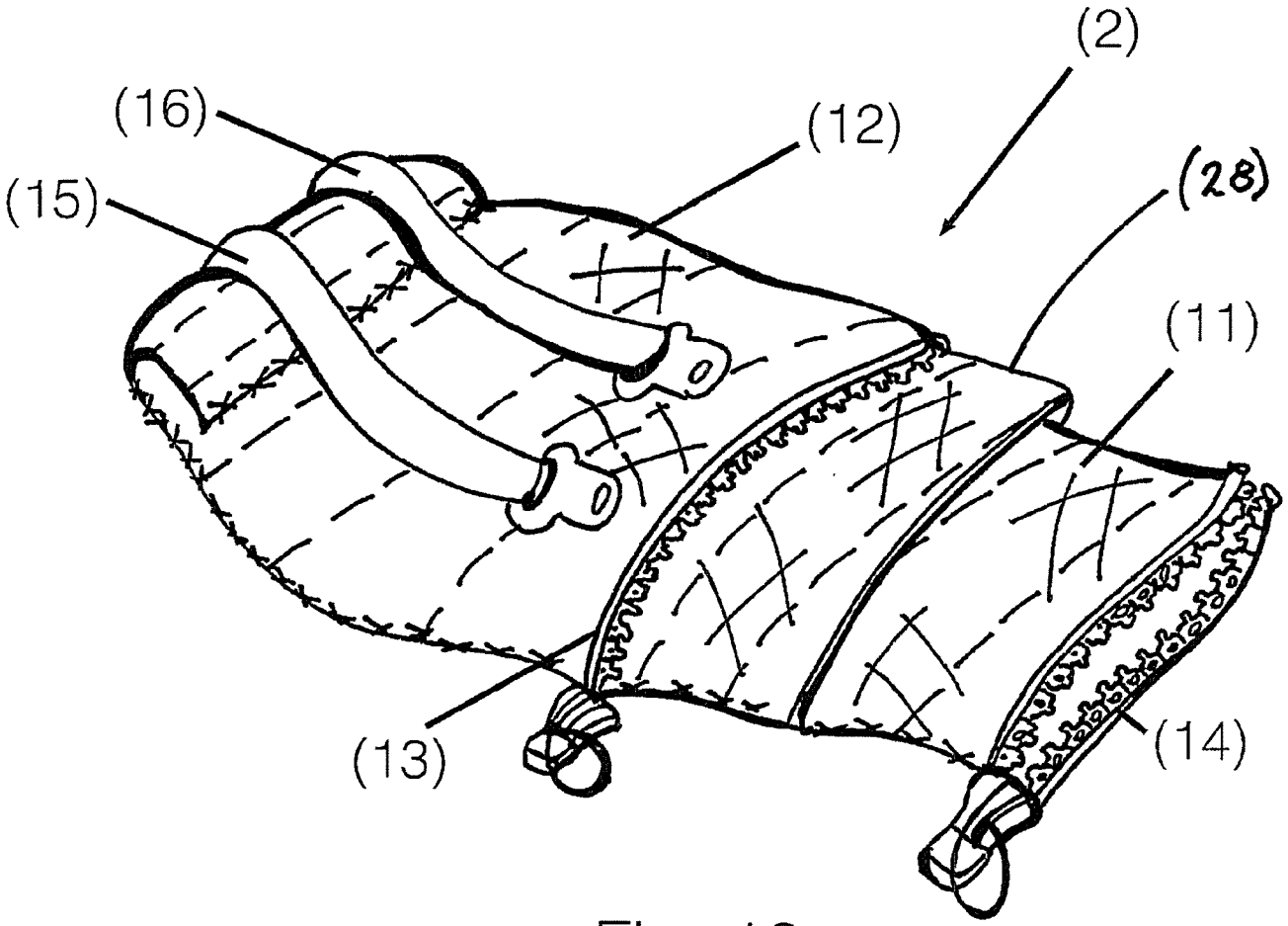
FIG. 10 is a schematic view of the blast mitigation device of FIG. 9 opened and ready to receive the explosive)

The inner diameter of the reinforcing 'shield' (28) is slightly greater than the outer diameter of the inner bag (11), but however it is such to be contained within the outer bag (12), such as shown in FIG. 9.

As regards the material of the outer bag (12), in the preferred solution, as mentioned above it is multi-layer para-aramid fabric, particularly provided with five layers.

Examples of such fabric are those available on the market under the tradename KEVLAR DUPONT, TWARON and TECHNORA TEIJIN.

More in general the layers can be two, three, four or even more than five: thus it is possible to say that the fabric generally is a multi-layer one with a number of layers equal to or greater than two.

The number of layers can be selected by the person skilled in the art in the light of information provided here on the basis of considerations regarding the dimensions and the behavior of the device (1) or (2).

It has to be deformable, foldable and flexible, such to make a device (1) or (2) that in the condition of non-use can be folded and stored in small spaces and can be handled comfortably only by one person.

If the fabric composing the outer bag (12) is desired to be characterized at a greater extent and more generally, it is a multifilament fabric of synthetic fibers, porous, gas permeable, with a high resistance.

In addition to para-aramid, composing the outer bag (12) just described, valid alternatives can be UHMW-PE ("Ultra- High-Molecular-Weight Polyethylene"), HM-PP ("High Modulus Polypropylene") or LCPs ("Liquid Crystal Polymers").

As regards the inner bag (11), the same considerations described above are valid, with the difference that an evolved configuration provides to interpose a foamed material, preferably polyethylene, inside the para-aramid layers.

For example for the inner bag (11) it is possible to use the material that is on the market under tradename "TWARON" by company Teijin Aramid or the one under tradename "INNEGRA" by company Innegra Technologies LLC or combinations thereof in hybrid fabrics, that is composed of fibers of different materials.

The use of TWARON mentioned above has found to be the better one for the outer bag (12).

As regards this aspect it is important to point out also some additional characteristics of the device (1) or (2).

Firstly the porosity to gases of the bags (11), (12) and of the 'shield' (28), considering the configuration (2) of the device, derives from a well specific choice: the idea at the base of the invention aims at mitigating the explosive effects by a controlled dissipation of the overpressure generated by the explosion.

The choice of fabrics permeable to gases, particularly to air aims at obtaining the maximum mechanical strength together with the mitigation of the gaseous expansion peak following an explosive event, and not at containing gases or fumes.

Moreover the fact of overlapping several layers of fabric having a considerable porosity guarantees to reach the necessary mechanical strength required to the container, and at the same time, to obtain a level of permeability to air sufficient to contain the inner pressure for some dozens of seconds following the explosion and then to promote its gradual dissipation, therefore preventing overpressure peak from reaching the surrounding structures.

From the studies and experiments carried out by the inventors, it results that the overpressure peak is the one that risks to cause the most dangerous damages to the disadvantage of the structural parts of the aircraft. Therefore, in the configuration (1) or (2), the technical characteristics of the device, even if allowing the exploded gas to escape from the device, slow down the escape thereof, therefore limiting the intensity of the pressure wave deriving therefrom.

Moreover it has to be noted that possible additional connections between the bags (11), (12) and (28) in the case of configuration (2) are not structural connections.

It has still to be noted that advantageously the used material preferably is flame-resistant, both by its inherent characteristic and also by means of a flame-resistant coating that may be applied later.

Figure 11:
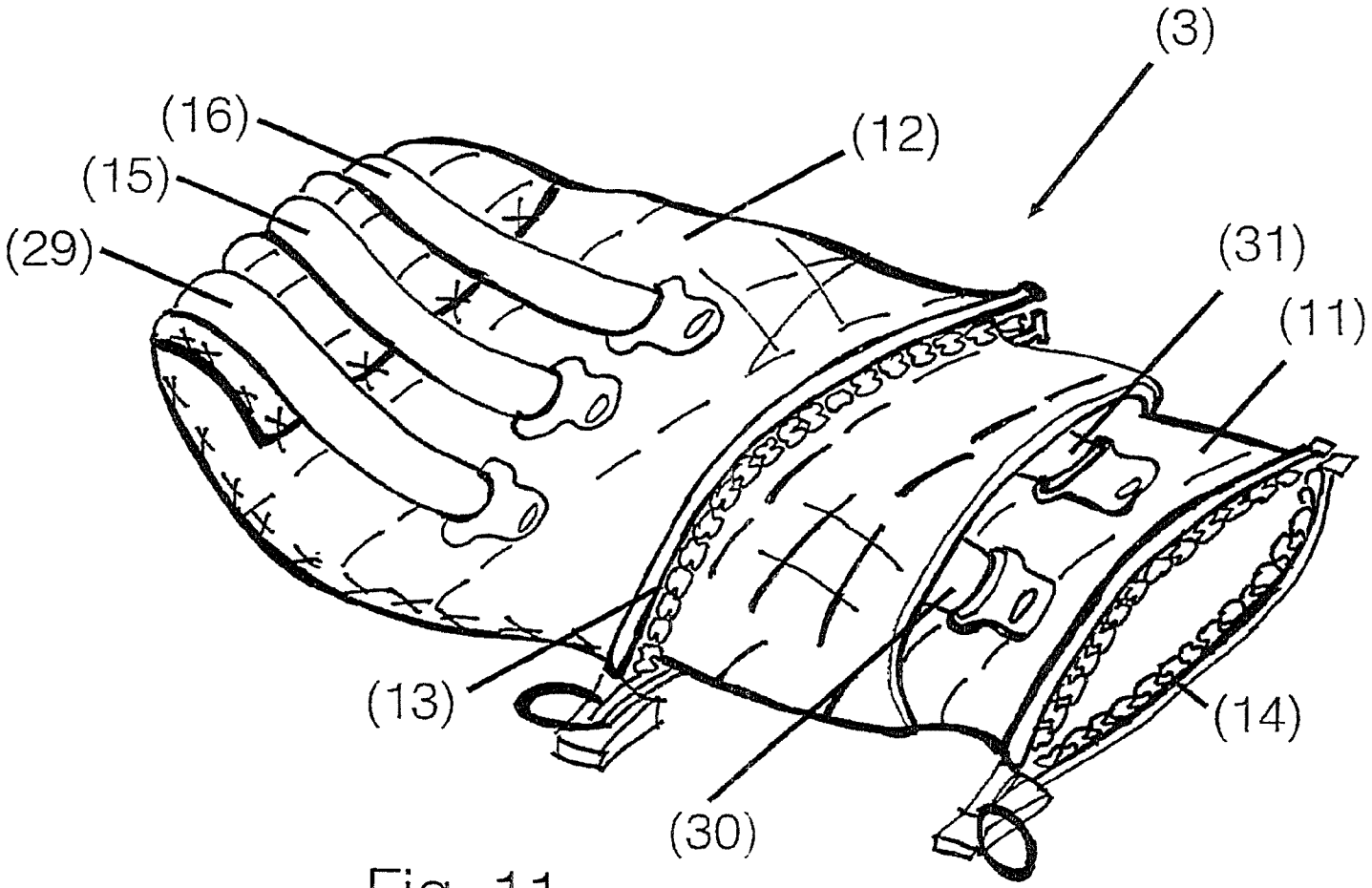
FIG. 11 is a schematic view of a blast mitigation device according to yet another embodiment of the invention opened and ready to receive the explosive.

A variant of the embodiment (2) of the device is shown in FIG. 11 and it is generally denoted by the reference numeral (3).

It provides to use three belts or straps (15), (16) and (29) on the outer bag (12) and two straps or belts (30), (31), on the inner bag (11).

According to other embodiments the use of a further protective bag (not shown) is provided which houses the outer bag (12) therein (configuration (4) of the device). The additional protective bag is made of a flame-retardant fabric and preferably anti-UV and moisture protective fabric, such that, even when it is not in use, the material of the bags (11), (12) (and possibly (28)) of the blast-resistant device are protected over time.

The blast mitigation device according to the invention can advantageously be folded and stored in a storage compartment, inside the aircraft approved to be fire resistant according to aviation rules.

To this end, deformability and the light weight are important characteristics of the device.

The deformability determines its ability of being folded and easily deployed again ready to be used.

Moreover by the construction denoted above, the blast mitigation device of the invention has been found to have the maximum inner volume available such to operate also inside the passenger compartment.

As described above, the permeability of the single container or bag is an important characteristic of the device: since it allows the overpressure generated from the explosion to be released in a controlled manner, minimizing the effects towards adjacent structures.

A further important parameter of the device of the invention is the volume available for the expansion provided by the suggested solution.

From the above it is therefore clear that the device 1 just described is particularly useful when manufactured for containing a blast or explosion of an explosive device within a aircraft; therefore, even more, it is usable on an aircraft for containing possible electronic devices whose batteries could exploded (by way of example a storage for electronic devices, such as "tablet", "laptop" or the like).

Obviously, in this case, it is possible to select suitable shape and dimensions for the blast-resistant device.

Similarly it is also clear that the blast-resistant device just described, in its several configurations, can be used very advantageously in other places, different from the aircraft, for example a shopping center or the like.

It has also to be noted that in use it is also possible optionally to provide to insert within the blast-resistant device sacrificial material with the explosive device or with the explosive, for example pillows, blankets or the like that help in mitigating the shock wave, without for this reason departing from the scope of protection defined below.

Thus the aim mentioned in the preamble of the description is achieved.

Obviously, the shapes of the structure for manufacturing a blast mitigation device of the invention can be different from those shown only by way of non-limitative example in the drawings, as well as also the materials and assembling methods can be different.

Figures 12, 12A, 12B:
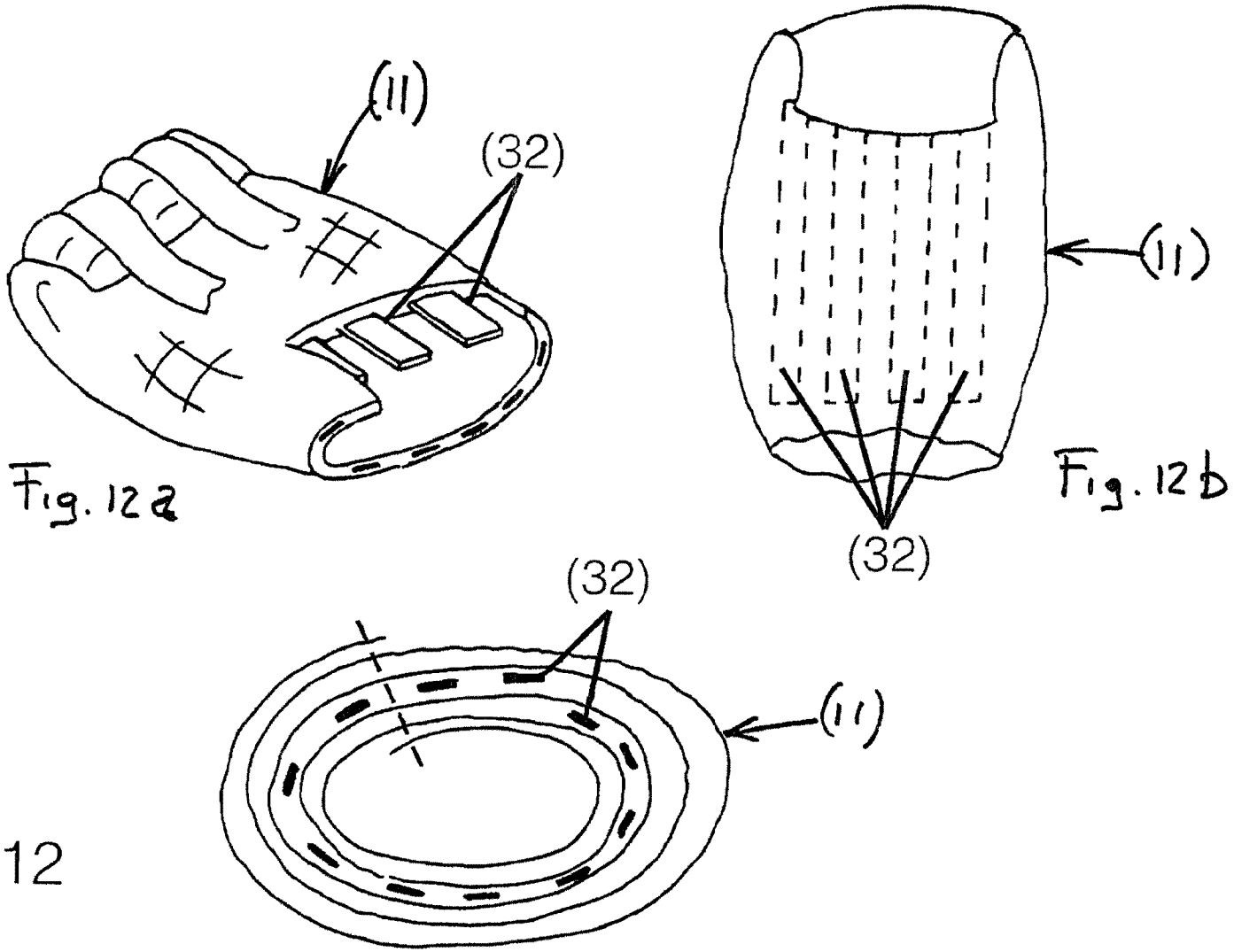
FIG. 12, 12*a*, 12*b* are a schematic view of details of a blast mitigation device according to yet another embodiment of the invention.

According to another optional feature shown in FIG. 12, 12*a*, 12*b*, the device according to the invention can be also provided by reinforcing strips (32).

Reinforcing strips (32) are shown joined to the internal bag (11), although they can be provided joined alternatively or incombination to the external bag (12) and/or to the shield (28).

Reinforcing strips (32) are preferably made of metallic or fiber reinforced plastic material, such for example, aluminum or aramidic based polymeric composite materials with thickness from 1 to 3 mm.

Reinforcing strips (32) lies preferably perpendicular to the open mouth of the bag, as shown in FIG. 12*a*.

Reinforcing strips (32) are preferably inserted between adjacent layers of the bag (11) and stitched at their ends to the adjacent textile layers, so that the strips form an integral part with the bag itself.

Reinforcing strips (32) are shorter than the bag to which they are applied, so that to allow the winding or rolling of the blind bottom and the mouth with the zip. The scope of protection of the invention therefore is delimited by the annexed claims.

The invention claimed is:

1. A blast mitigation device, comprising a first inner bag configured to house an explosive; and a second outer bag wherein the first inner bag is housed freely in the second bag;

structural connections between the first and the second bags are absent, the first bag comprising a first flexible tubular body made of textile material, provided with at least one first openable mouth at one end of said first flexible tubular body, the second bag comprising a second flexible tubular body made of textile material, provided with at least one second openable mouth at one end of said second flexible tubular body, each of said first and second mouths being closable by a respective zip fastener and wherein at least the second bag comprises one or more closure belts arranged transversely with respect to said openable mouth, such that in an assembled and use condition an end portion of the body of the corresponding bag is wound on itself, forming a roll, said zip fastener being wound inside said roll, said roll being kept in position by said at least one closure belt.

2. The blast mitigation device according to claim 1, wherein the textile material of said first and second bags is synthetic textile material.

3. The blast mitigation device according to claim 1, wherein the textile material between the first and the second bags is a multi-layer material made of a single piece of textile material wound on itself for a number of times equal to a number of textile layers of the multi-layer material, seams being provided between the individual layers.

4. The blast mitigation device according to claim 3, wherein the first bag comprises at least one layer of foamed material interposed between two textile layers.

5. The blast mitigation device according to claim 1, wherein at least one of said first and second bags comprises only one openable mouth and a blind bottom on a side of a body of the bag opposite to said openable mouth, said blind bottom being formed by a flattened end portion of the flexible tubular body of the bag adjacent to the blind bottom, said flattened end portion being further folded and fastened by a series of seams which are transversal to the flexible tubular body and parallel with each other, with a zig-zag and crossed pattern.

6. The blast mitigation device according to claim 1, further comprising a third bag acting as a reinforcement shield, interposed between the first and the second bags, said third bag being made of the same material as said first bag or said second bag.

7. The blast mitigation device according to claim 1, wherein the textile material is permeable to gases.

8. The blast mitigation device according to claim 1, comprising one or more reinforcement belts or straps on said first inner bag.

9. The blast mitigation device according to claim 1, wherein at least one of the first inner bag or the second outer bag has two openable mouths at opposite sides of its flexible tubular body.

10. The blast mitigation device according to claim 6, wherein reinforcing strips extending substantially perpendicularly with respect to said zip fastener are provided on at least one of the first inner bag, the second outer bag, or the third bag.

11. A method for containing an explosion, comprising at least a step of using a blast mitigation device according to claim 1.

* * * * *